US011697520B2

(12) United States Patent
Schmoker et al.

(10) Patent No.: US 11,697,520 B2
(45) Date of Patent: Jul. 11, 2023

(54) FLEXING LABEL APPLICATOR

(71) Applicant: ID Technology LLC, Ft. Worth, TX (US)

(72) Inventors: Ronald Lee Schmoker, Littleton, CO (US); Matthew D. McLean, Owings Mills, MD (US)

(73) Assignee: ID TECHNOLOGY LLC, Fort Worth, TX (US)

( * ) Notice: Subject to any disclaimer, the term of this patent is extended or adjusted under 35 U.S.C. 154(b) by 0 days.

(21) Appl. No.: 17/903,678

(22) Filed: Sep. 6, 2022

(65) Prior Publication Data

US 2023/0045251 A1 Feb. 9, 2023

Related U.S. Application Data

(60) Provisional application No. 63/317,709, filed on Mar. 8, 2022.

(51) Int. Cl.

| | |
|---|---|
| ***B65C 9/26*** | (2006.01) |
| ***B65C 9/46*** | (2006.01) |
| ***B65C 9/02*** | (2006.01) |

(52) U.S. Cl.

CPC ..... *B65C 9/26* (2013.01); *B65C 9/02* (2013.01); *B65C 9/46* (2013.01)

(58) Field of Classification Search

CPC .... B65C 9/02; B65C 9/26; B65C 9/36; B65C 9/46

See application file for complete search history.

(56) References Cited

U.S. PATENT DOCUMENTS

| | | | | |
|---|---|---|---|---|
| 4,574,027 | A * | 3/1986 | Weinundbrot | B65C 9/1884 156/541 |
| 6,006,008 | A | 12/1999 | Klaffenbach | |
| 6,817,397 | B2 | 11/2004 | Bixen | |
| 7,462,252 | B2 * | 12/2008 | Schaller | B65C 9/30 156/227 |
| 10,287,050 | B2 | 5/2019 | Roe | |
| 11,192,675 | B2 | 12/2021 | Snedecor | |
| 11,225,350 | B1 | 1/2022 | Koch | |
| 2003/0041973 | A1 | 3/2003 | Soto | |
| 2021/0086939 | A1 * | 3/2021 | Snedecor | B65C 9/02 |

* cited by examiner

*Primary Examiner* — George R Koch

(74) *Attorney, Agent, or Firm* — Thompson Hine LLP

(57) ABSTRACT

A label applying system includes a conveyance path for moving an item in a conveyance direction, and a label applicator With an elongated label applying arm pivotably moveable between a label load position spaced away from the item and a label apply position in which a free end of the elongated label applying arm is moved into contact with the item. The elongated label applying arm is configured to be sufficiently flexible such that at least a label carrying portion of the elongated label applying arm bends, as it moves into contact with the item, for pressing a label against the item.

28 Claims, 8 Drawing Sheets

FLEXING LABEL APPLICATOR

TECHNICAL FIELD

The present application relates generally to label applying and, more particularly, to a label applying system for labeling items conveyed along a path.

BACKGROUND

Material handling systems are used in many different industries and often include complex packaging and conveyor systems that convey items, such as cases (boxes) or pallets, quickly from one place to the next within a facility or multiple facilities. Labeling is often necessary to convey information about the cases so that the cases can be identified, categorized, and/or properly routed, among other reasons.

Various label applicators are known. However, a label applicator that effectively applies labels to conveyed items, even when the conveyed items are offset from an expected orientation, would be desirable.

SUMMARY

In one aspect, a label applying system includes a conveyance path for moving an item in a conveyance direction, and a label applicator comprising an elongated label applying arm pivotably moveable between a label load position spaced away from the item and a label apply position in which a free end of the elongated label applying arm is moved into contact with the item. The elongated label applying arm is configured to be sufficiently flexible such that at least a label carrying portion of the elongated label applying arm bends, as it moves into contact with the item, for pressing a label against the item.

In a further aspect, a label applying system includes a conveyance path for moving an item in a conveyance direction, a label printer with a label output, and a label applicator with an elongated label applying arm pivotably moveable between a label load position spaced away from the item and in which a free end of the elongated label applying arm is located proximate the label output and a label apply position in which the free end of the elongated label applying arm, with a given label thereon, is moved into contact with the item. The elongated label applying arm is configured to be sufficiently flexible such that at least the free end of the elongated label applying arm bends, as the free end moves into contact with the given item, for pressing the given label against the item.

In yet a further aspect, a label applying system includes a label print unit with an associated label output, a motor, a shaft connected to the motor for being rotated by the motor, and an elongated label applying arm connected to the shaft for pivotable movement between a label load position and a label apply position. The elongated label applying arm includes a label carrying free end portion that is positioned to receive labels from the label output when the elongated label applying arm is in the label load position, wherein the elongated label applying arm is configured to be sufficiently flexible such that the elongated label applying arm bends, as the elongated label applying arm moves into contact with an item, for pressing a label against the item.

In another aspect, a method of applying a label to an item moving along a conveyance path involves the steps of: feeding the label onto a free end of a label applying arm, where the free end is spaced away from a movement path of the item; pivoting the label applying arm to move the free end, with the label thereon, toward the movement path and into contact with the item; wherein the label applying arm is configured to be sufficiently flexible such that at least the free end of the label applying arm bends, as the free end moves into contact with the item, for pressing the label against the item.

The details of one or more embodiments are set forth in the accompanying drawings and the description below. Other features, objects, and advantages will be apparent from the description and drawings, and from the claims.

DETAILED DESCRIPTION

Figure 1:
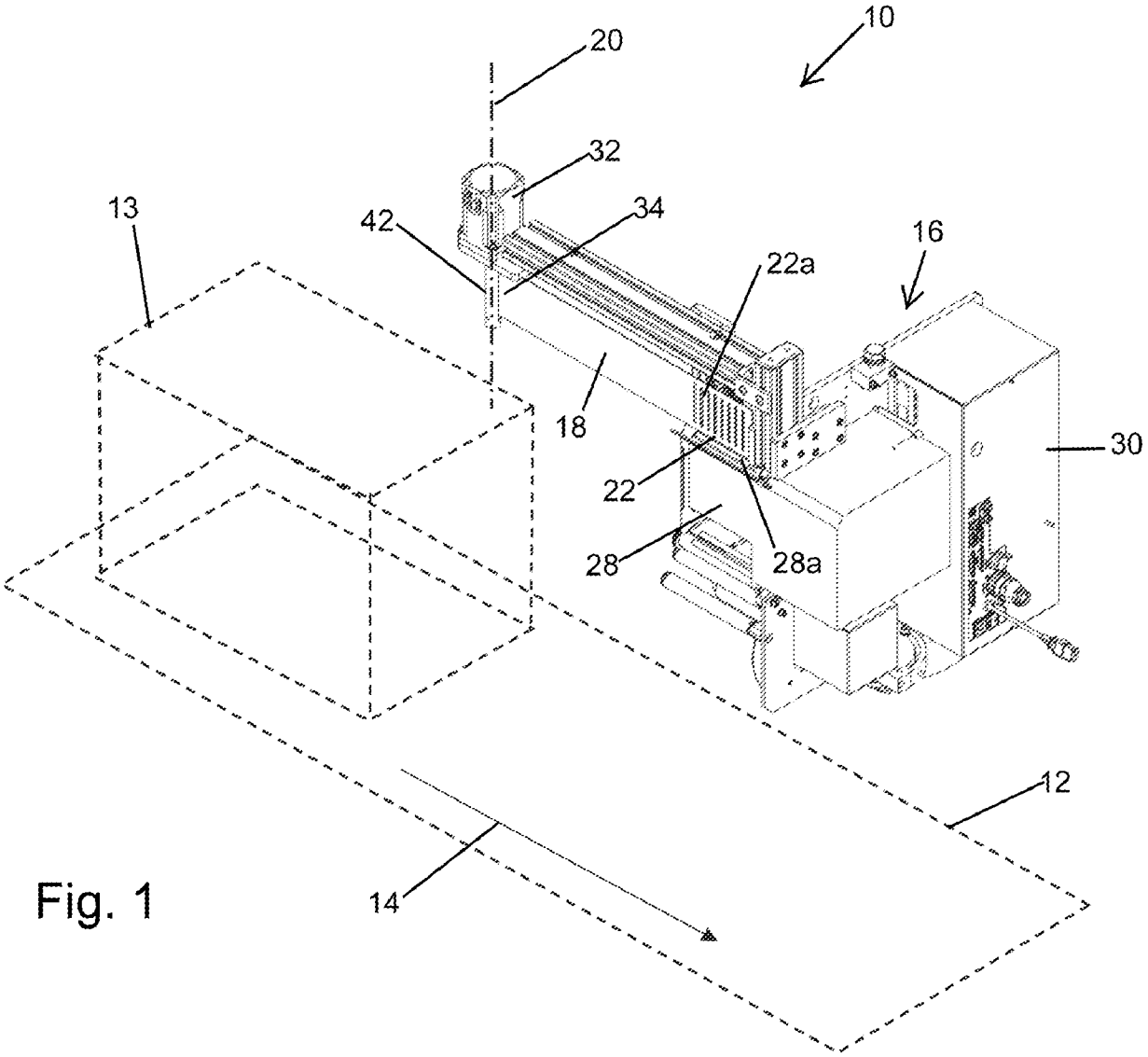
FIG. 1 is a perspective view of a label applying system.
Figure 2:
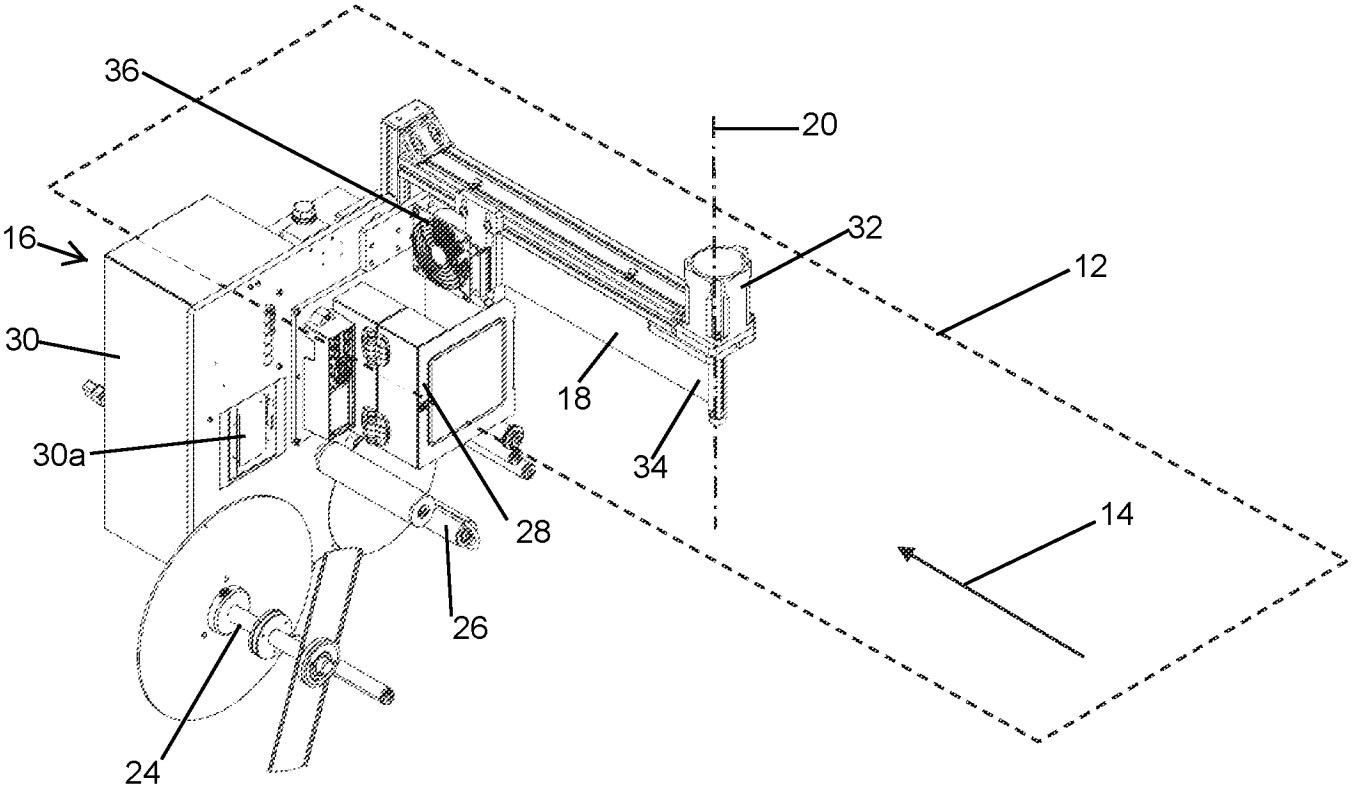
FIG. 2 is another perspective view of the system.

Referring to FIGS. 1-6, a label applying system 10 includes a conveyance path 12 (e.g., formed by any suitable conveyor technology, such as a roller conveyor or belt conveyor) for moving items, along an item conveyance path 13*a* in a conveyance direction 14, and a label print and apply unit 16. Here, the label print and apply unit 16 is arranged alongside the conveyance path 12 and includes a label applying arm, here an elongated label applying arm 18, that is pivotably moveable, via rotation about a pivot axis 20, between a label load position 18*a* spaced away from the item and a label apply position (e.g., 18*b*, 18*c*, 18*d*) in which a free end 22 of the elongated label applying arm 18 is moved into contact with the item.

Here, the label print and apply unit includes a support arm 24 for holding a label stock supply roll, an arm 26 for holding a label backing take-up roll, a label print unit 28 and a control system 30. The label print unit 28 includes a label output 28*a* positioned to feed printed labels onto a label carrying portion of the elongated label applying arm 18, which, in this case, is at the free end 22 of the elongated label applying arm. A motor 32 (e.g., a servomotor) is operatively connected to a drive end 34 of the elongated label applying arm for effecting pivot of the elongated label applying arm about the pivot axis 20.

By way of example, in embodiments, the motor 32 is configured to pivot the elongated label applying arm with a torque of at least 0.14 nm (e.g., at least 0.16 nm) and/or at a rotational acceleration of at least 400 degrees/second (e.g., at least 450 degrees/second), ignoring elongated label applying arm flex. In embodiments, the elongated label applying arm 18 has a length L of between eight inches and twenty-four inches (e.g., between twelve inches and twenty inches, such as between fourteen inches and eighteen inches).

Figure 3:
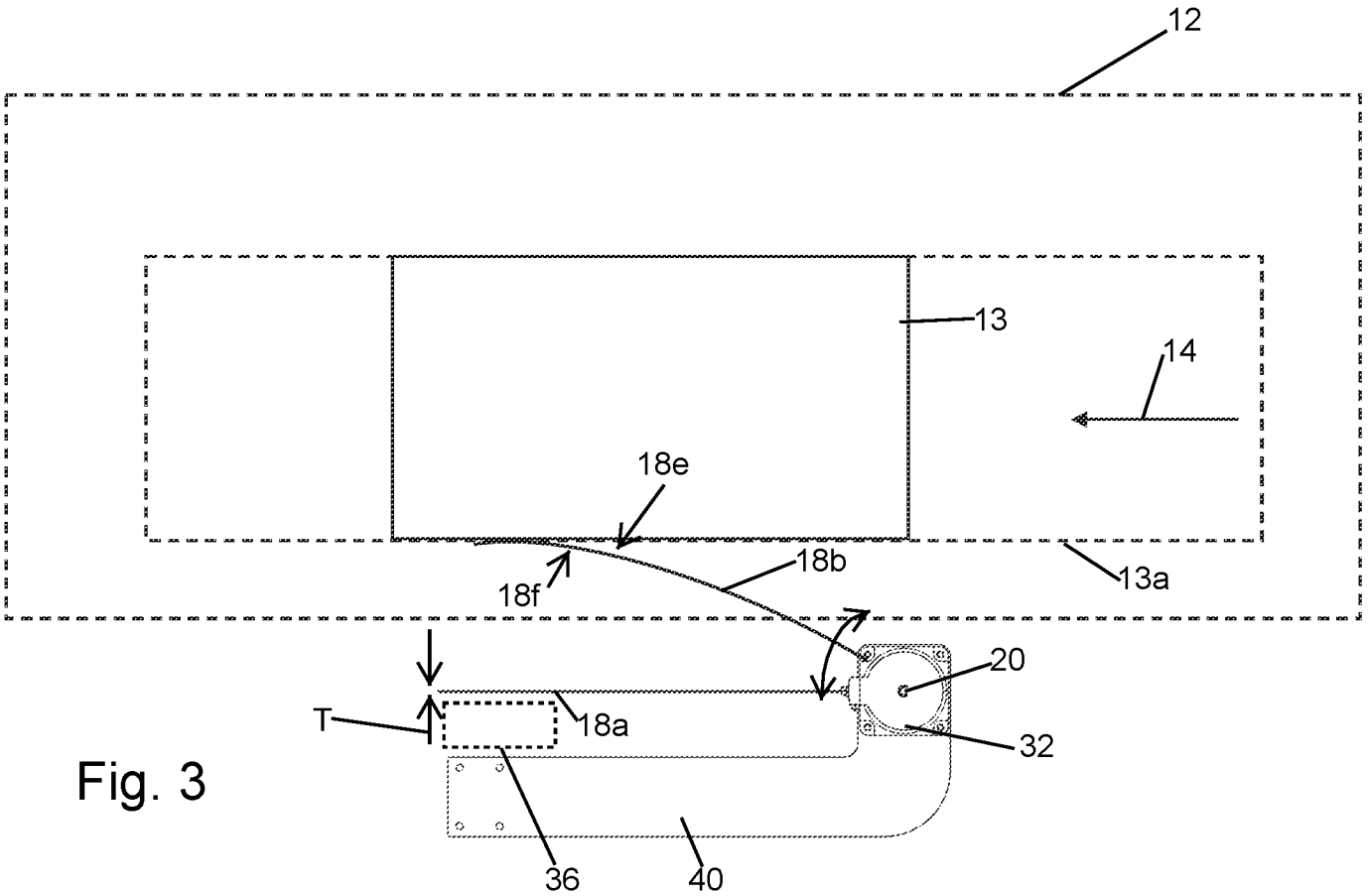
FIGS. 3-5 are partial top plan views of the system applying labels to items in different orientations.

Notably, the elongated label applying arm is configured to be sufficiently flexible such that at least the label carrying portion of the elongated label applying arm bends, including bending of the label contacting surface of the label carrying portion, as the label carrying arm moves into contact with the item, for pressing a label against the item, per elongated label applying arm position 18*b* shown in FIG. 3. When the elongated label applying arm is in the label load position depicted by 18*a*, the elongated label applying arm is generally planar (e.g., formed of a thin sheet material or thin plate material). The elongated label applying arm is also configured so as to have shape memory (e.g., elastically bendable), which causes the elongated label applying arm to move back to the planar configuration when the elongated label applying arm pivots out of contact with the item 13. In some embodiments, the elongated label applying arm 18, or at least the label carrying portion that bends upon contact with items, is formed of a carbon fiber material, which is particularly light and durable. In such carbon fiber embodiments, a thickness T of between about 1.0 mm and about 2.0 mm in combination with a 0/90 weave of carbon fibers, with the fibers running parallel to the elongated label applying arm length and perpendicular to the elongated label applying arm length, has been found to be desirable, but variations are possible. Arms of other materials, that are configured to be sufficiently flexible, are also possible.

In the illustrated embodiment per FIG. 3, substantially the full length of the elongated label applying arm 18 is flexible and, therefore, during label application, some bend occurs along a majority (i.e., greater than 50% (e.g., 60% or more)) of the length L of the elongated label applying arm, but with a greater amount of bend occurring at the free end, resulting in a bend of continuous curve form as shown in the drawings.

Here, the free end 22 of the elongated label applying arm includes a plurality of openings 22*a* that pass through the elongated label applying arm from a label carrying side 18*e* of the elongated label applying arm to the opposite side 18*f* of the elongated label applying arm. When the elongated label applying arm 18 is in the label load position of FIGS. 1 and 2, an air mover 36 (e.g., a fan) is operatively associated with the free end to create a pressure drop across the elongated label applying arm, via the plurality of openings 22*a*, so as to hold a label on the label carrying portion once the label is fed by the label print unit 28. When the elongated label applying arm moves toward the label apply position, the air mover, which does not move with the elongated label applying arm 18, is no longer operatively associated with the free end 22. However, the acceleration of the pivoting elongated label applying arm, in combination with frictional forces between the elongated label applying arm and the label, are sufficient to keep the label on the elongated label applying arm until the free end of the elongated label applying arm pushes the label into contact with the item 13.

Figure 4:
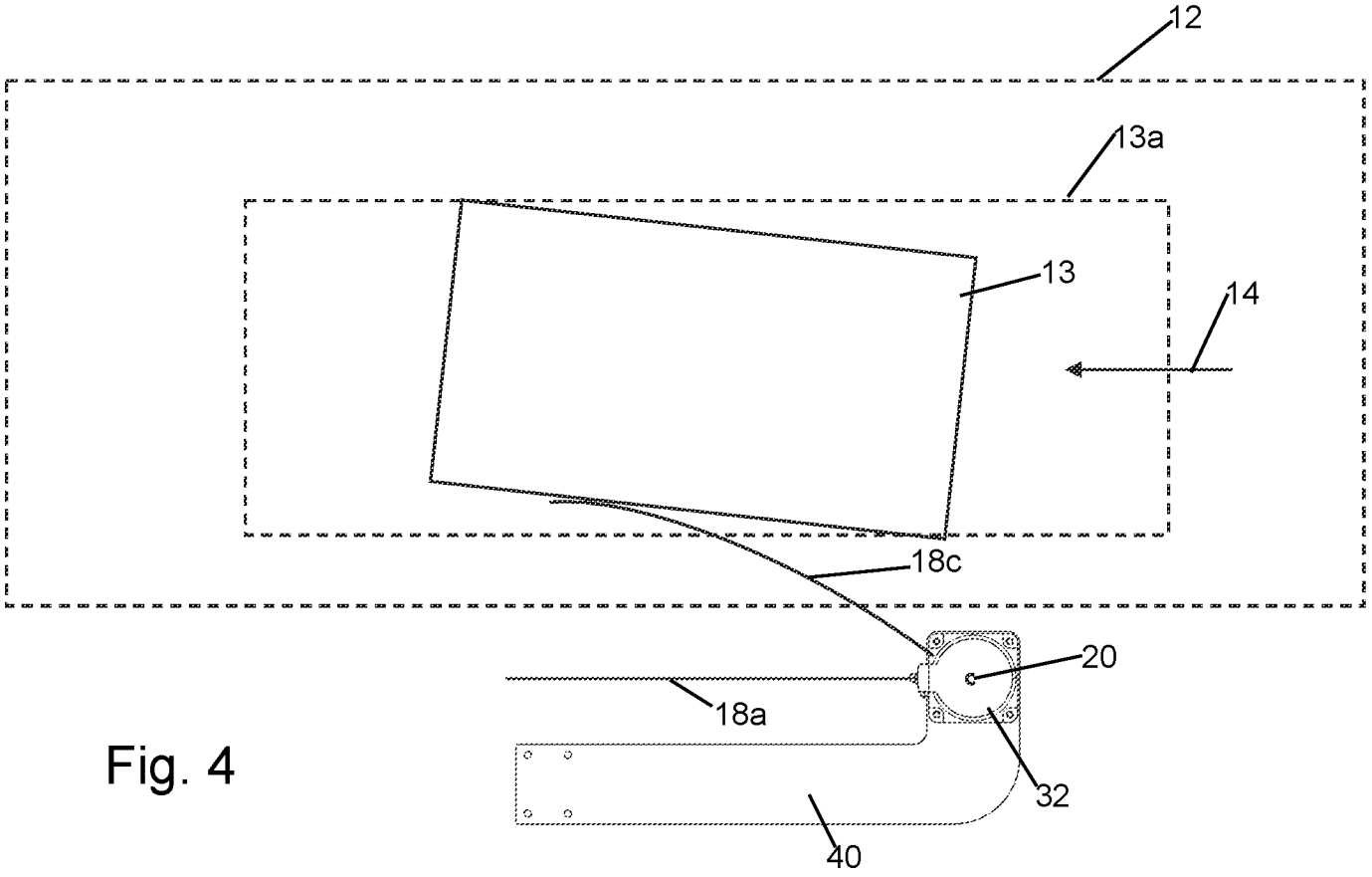
Figure 5:
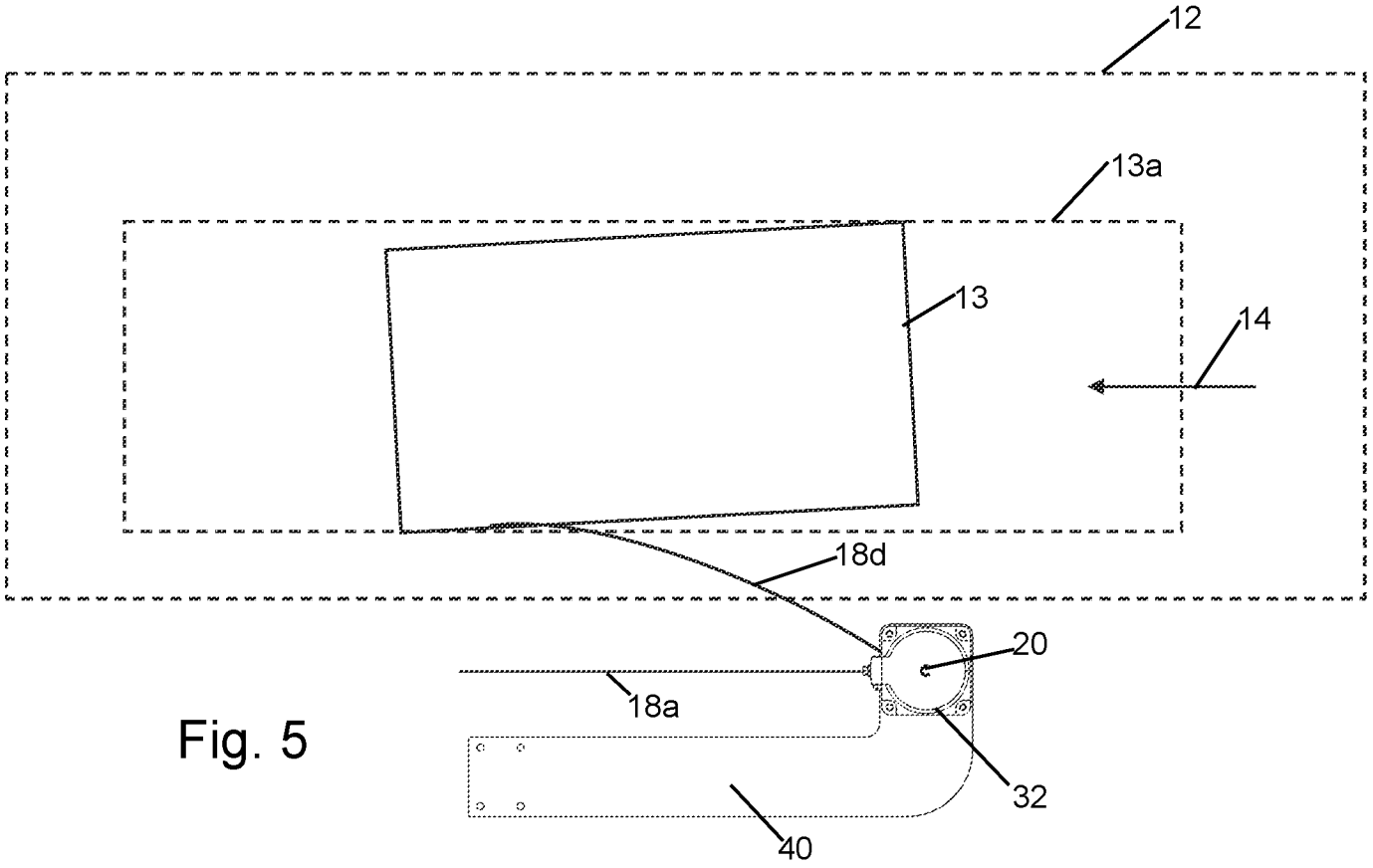
Figure 6:
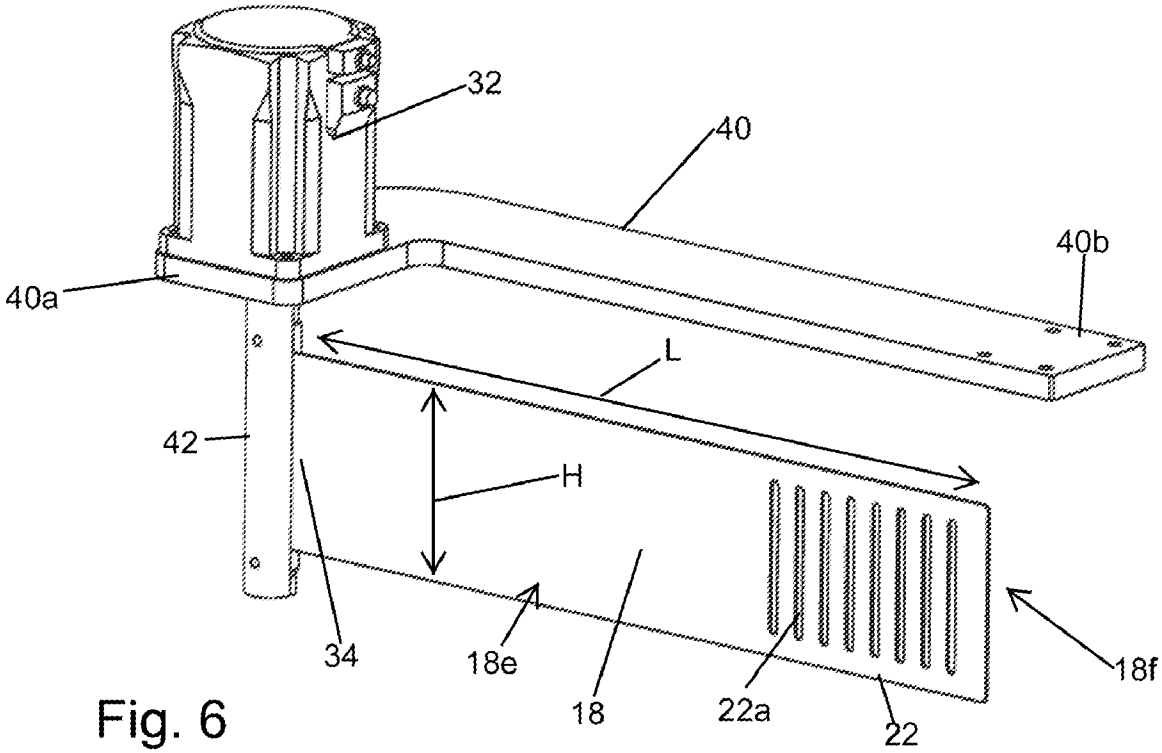

Notably, the use of the flexible elongated label applying arm 18 to apply labels to moving items facilitates application of labels to items even when the items are not in an expected or desired orientation. For example, FIGS. 4 and 5 show exemplary label applying positions 18*c* and 18*d* of the elongated label applying arm when the item 13 is askew (i.e., the side of the item is not parallel to the movement direction 14).

As suggested in FIGS. 3-6, in embodiments, the motor 32 may be positioned at one end 40*a* of a rigid mount arm 40, where the opposite end 40*b* of the arm 40 is used for connection to the rest of the label print and apply unit 16. A drive shaft 42 extends from the motor 32 and the drive end 34 of the elongated label applying arm 18 is connected to the shaft 42. Here, the elongated label applying arm is directly connected to the motor shaft 42 for rotation by the motor 32. Also, the rigid mount arm 40 is of a rigid support plate configuration, with the motor 32 mounted on one side face 40*c* of the support plate in alignment with a plate opening 40*d* through which the drive shaft 42 extends.

Figure 7:
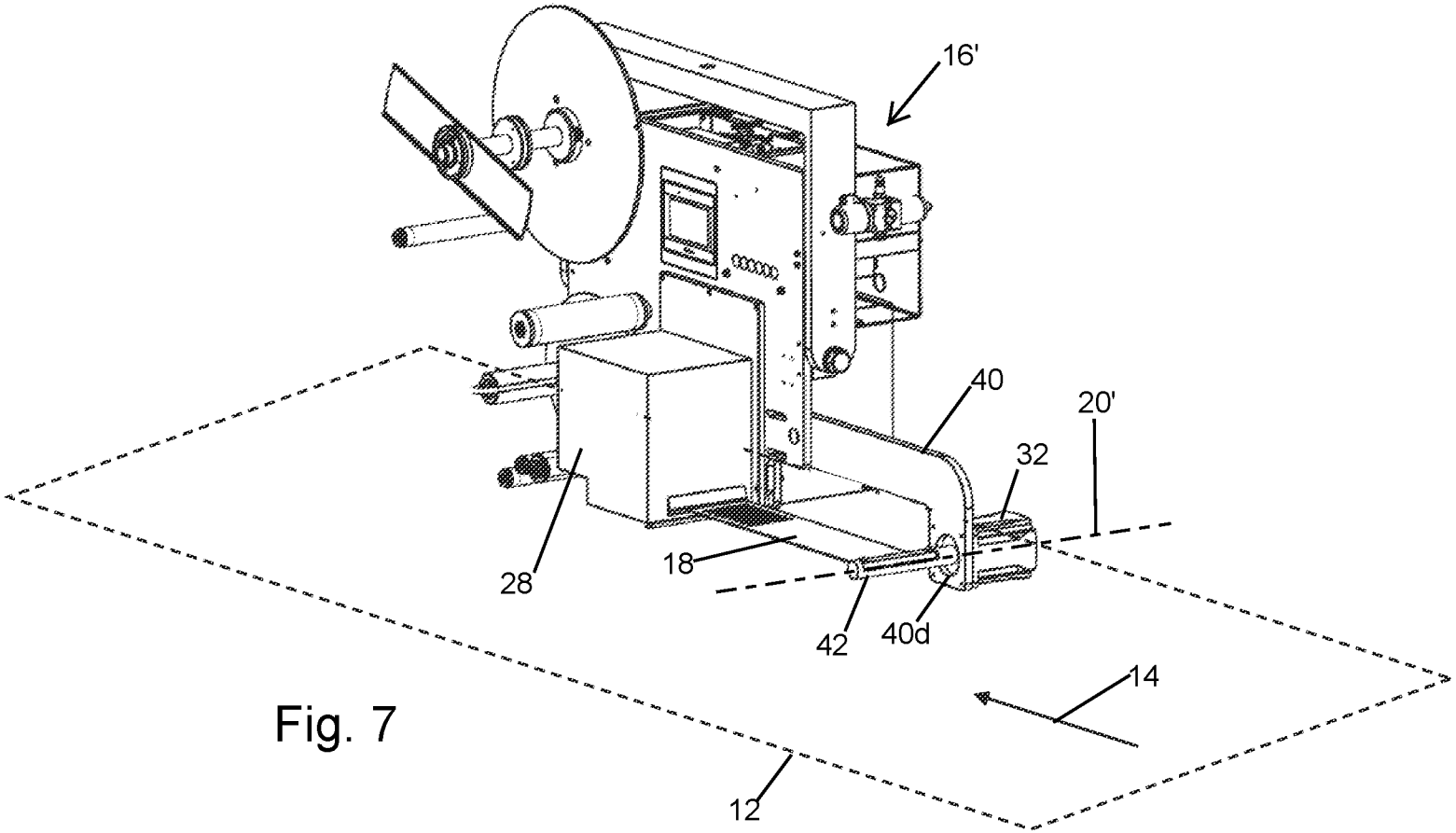
FIG. 7 is a perspective view of another embodiment of a label applying system.
Figure 8:
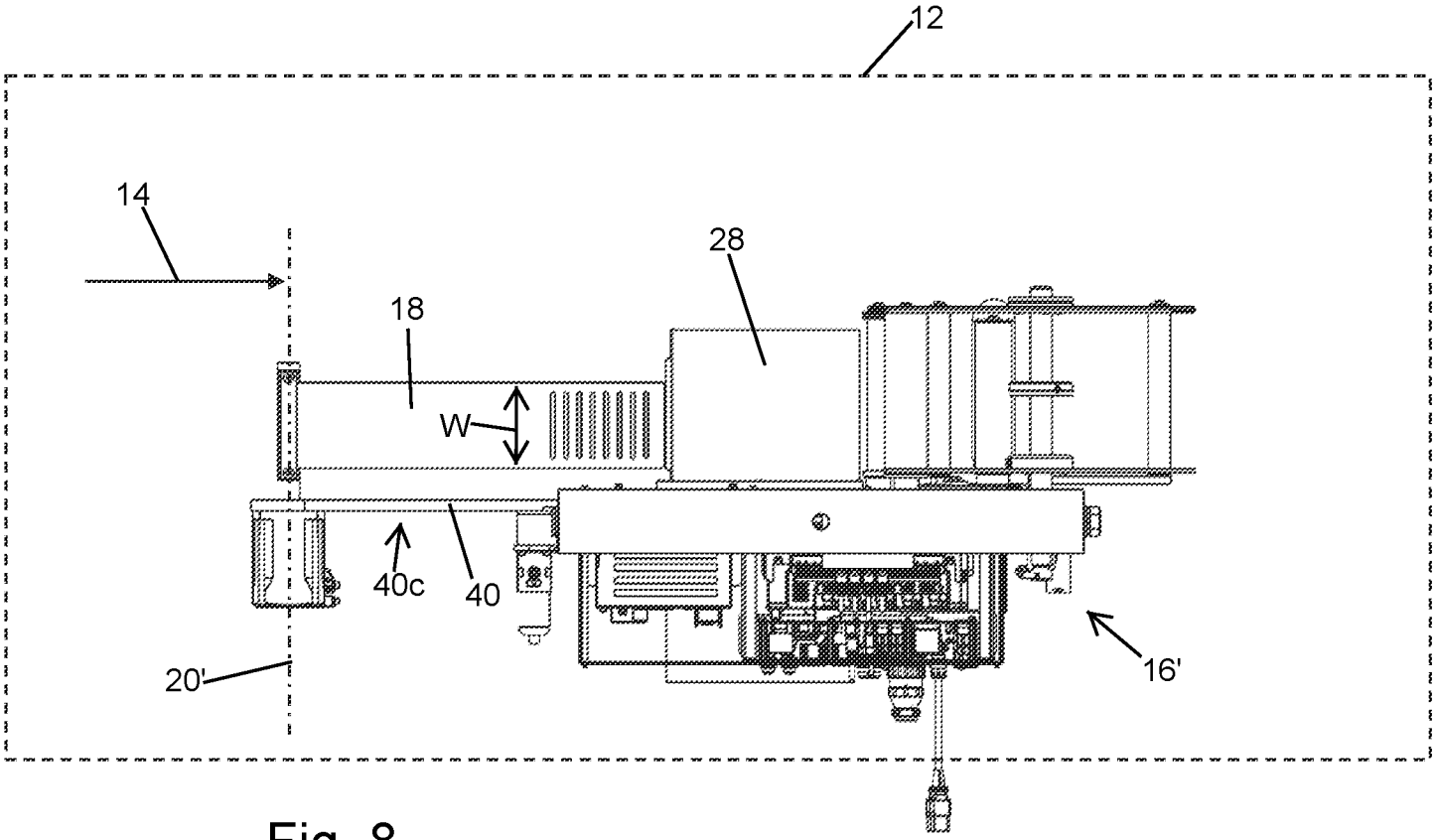
FIG. 8 is a top plan view of the system of FIG. 7.

Although the above-described embodiment depicts an arrangement in which the label applying arm 18 is configured to pivot around a vertical pivot axis 20 towards the moving items, other arrangements are possible. For example, FIGS. 7 and 8 depict an arrangement in which the label print and apply unit 16' is configured such that the label applying arm 18 is oriented and positioned to apply labels downward onto items by pivoting around a horizontal pivot axis 20'.

The embodiments above all provide a method of applying a label to an item moving along a conveyance path, the method including: feeding the label onto a free end of a label applying arm, where the free end is spaced away from a movement path 13*a* of the item; pivoting the label applying arm to move the free end, with the label thereon, toward the movement path and into contact with the item; wherein the label applying arm is configured to be sufficiently flexible such that at least the free end of the label applying arm bends, as the free end moves into contact with the item, for pressing the label against the item.

In embodiments, the control system 30 is configured to rotate the elongated label applying arm in a controlled manner. For example, the control system 30 is configured to rotate the elongated label applying arm from the label load position to a location specified in the control system program, which location may be modified by the customer (e.g., via a user interface 30*a*). For example, a target rotation angle of between 50 degrees and 120 degrees may be specified (e.g., 110 degrees for an intended application of a label to the front side of a moving box/carton or 60 degrees for an intended application of a label to a lateral side of a moving box/carton). After reaching the target rotation angle, the control system may cause the arm to rotate back to the label load position immediately, as reaching full rotational swing may not be desirable. If the control system detects (based upon servo-motor feedback) application of force to the arm during rotation toward the target rotation angle, or the arm contacting something via being out of position, the control system may dwell the arm position for a user selectable time (e.g., 0 to 1,000 milliseconds), while maintaining a user selectable force of the arm in contact with the item being labeled, and then effects rotation of the arm back to the label load position. For an intended corner wrap label application in which part of the label is applied to the front side and part of the label is applied to the lateral side, the control system may initially rotate the arm toward a target rotation angle of, for example, 100 degrees and, upon detection of arm contact with the item, change to a lesser target rotation angle (e.g., 40-60 degrees) to enable the label to be "wiped" around the corner of the box/carton and onto the lateral side. The control system may utilize one or more item detecting sensors to trigger the printing and dispensing of the label onto the arm and subsequent motor operation to pivot the arm from the label load position toward the label apply position.

Although the illustrated elongated label applying arms have a substantially uniform dimension perpendicular to the length, variations are possible, such as arms in which a portion of the arm between the drive shaft and the label carrying portion have a smaller dimension (height H or width W depending on elongated arm orientation) than the corresponding dimension of the label carrying portion, enhancing flexibility of such portion of the arm. Variations in which both the motor shaft engaging arm portion and the label carrying arm portion have a larger height or width dimension, as compared to an intermediate arm portion extending between the motor shaft engaging arm portion and the label carrying arm portion, are also possible.

In some embodiments, for a given size, particularly length, of the elongated label applying arm, a relatively low moment of inertia is seen by the motor. This relatively low moment of inertia is, in part, achieved by the use of a relatively thin sheet material for the elongated label applying arm, which results in a relatively low mass per unit surface area for the arm. By way of example, implementation of arms having a mass per unit label side facing surface area of no more than 0.00650 pounds per square inch (e.g., such as no more than 0.00500 pounds per square inch, or no more than 0.00400 pounds per square inch) have been found desirable, where the label side facing surface area is the total surface area of the arm face that includes the surface that carries the label (e.g., H×L in the embodiment of FIG. 6).

In some embodiments, to provide a desired flexibility, the label carrying portion of the elongated label applying arm has a flexural modulus of no more than 10 msi (e.g., no more than 8 msi, such as no more than 6 msi, such as no more than 5 msi), calculated using the known formula $(L^3*F)/(4*W*H^3*D)$.

The foregoing is provided for purposes of illustrating, explaining, and describing embodiments of labeling apparatus. Modifications and adaptations to these embodiments will be apparent to those skilled in the art and may be made without departing from the scope or spirit of this application.

The invention claimed is:

1. A label applying system, comprising:

a conveyance path for moving an item in a conveyance direction;

a label applicator comprising an elongated label applying arm pivotably moveable between a label load position spaced away from the item and a label apply position in which a free end of the elongated label applying arm is moved into contact with the item;

wherein the elongated label applying arm is configured to be sufficiently flexible such that at least a label carrying portion of the elongated label applying arm bends, as the elongated label applying arm moves into contact with the item, for pressing a label against the item;

wherein at least the label carrying portion of the elongated label applying arm is of a sheet material or plate material configuration;

wherein the label carrying portion includes a label carrying side and an opposite side;

wherein the label carrying portion includes a plurality of openings that extend completely through the label carrying portion from the label carrying side to the opposite side;

an air mover located such that, when the elongated label applying arm is in the label load position, the air mover is positioned adjacent the label carrying portion such that the air mover creates a pressure condition at the label carrying portion to hold a label on the label carrying portion;

wherein, when the elongated label applying arm moves away from the label load position toward the label apply position, the label carrying portion moves away from the air mover and the pressure condition at the label carrying portion caused by the air mover is eliminated.

2. The label applying system of claim 1, wherein, when the label carrying portion moves away from the air mover such that the pressure condition at the label carrying portion caused by the air mover is eliminated, a rotational acceleration of the elongated label applying arm toward the label apply position, in combination with a frictional force between the label carrying portion and the label, keep the label on the label carrying portion until the elongated label applying arm pushes the label into contact with the item for applying the label.

3. The label applying system of claim 1, wherein the label carrying portion is formed of a carbon fiber material.

4. The label applying system of claim 1, wherein the elongated label applying arm is formed of a carbon fiber material.

5. The label applying system of claim 1, further comprising:

the elongated label applying arm comprising the free end and a drive end, wherein the label carrying portion is at the free end;

a motor operatively connected to the drive end for effecting pivot of the elongated label applying arm.

6. The label applying system of claim 5, wherein the motor is mounted on one side of a support in alignment with a through opening of the support, and a shaft extends from the motor through the through opening to engage the elongated label applying arm.

7. The label applying system of claim 5, wherein the motor is configured to pivot the elongated label applying arm:

with a torque of at least 0.14 nm;

and/or at a rotational acceleration of at least 400 degrees per second.

8. The label applying system of claim 1, wherein the elongated label applying arm has a length of between eight inches and twenty-four inches.

9. The label applying system of claim 1, wherein at least the label carrying portion is formed of an elastically deformable material.

10. The label applying system of claim 1, wherein at least the label carrying portion of the elongated label applying arm bends, in a continuous curve, as the elongated label applying arm moves into contact with the item.

11. The label applying system of claim 10, wherein the elongated label applying arm is configured such that, during label application, some bend occurs along greater than 50% of a length of the elongated label applying arm, with a greater amount of bend occurring toward the free end.

12. The label applying system of claim 1, wherein the elongated label applying arm is configured such that, as the label carrying portion of the elongated label applying arm bends, a label contacting surface of the label carrying portion also bends.

13. A label applying system, comprising:

a conveyance path for moving an item in a conveyance direction;

a label printer with a label output;

an air mover;

a label applicator comprising an elongated label applying arm pivotably moveable between a label load position spaced away from the item and in which a free end of the arm is located proximate the label output and a label apply position in which the free end of the arm, with a given label thereon, is moved into contact with the item;

wherein the elongated label applying arm is configured to be sufficiently flexible such that at least the free end of the elongated label applying arm bends, as the free end moves into contact with the given item, for pressing the given label against the item;

wherein the elongated label applying arm is configured as a sheet or a plate;

wherein the free end of the elongated label applying arm includes a label carrying side and an opposite side, and a plurality of openings that extend through the free end from the label carrying side to the opposite side;

wherein, when the elongated label applying arm is in the label load position, operation of the air mover creates a pressure condition at the free end to hold a label on the free end;

wherein, when the elongated label applying arm moves away from the label load position toward the label apply position, the free end moves away from the air mover and the pressure condition at the free end caused by operation of the air mover is removed.

14. A label applying system, comprising:

a label print unit with an associated label output;

a servomotor;

a shaft connected to the servomotor for being rotated by the servomotor;

an elongated label applying arm connected to the shaft for pivotable movement between a label load position and a label apply position, wherein the elongated label applying arm includes a label carrying free end portion that is positioned to receive labels from the label output when the elongated label applying arm is in the label load position, wherein the elongated label applying arm is configured to be sufficiently flexible such that the elongated label applying arm bends, as the elongated label applying arm moves into contact with an item, for pressing a label against the item; and a control system configured to operate the servomotor to rotate the elongated label applying arm in a controlled manner such that, as the elongated label applying arm is rotated toward the label apply position, when the control system detects, based upon servomotor feedback, application of a force to the elongated label applying arm, the control system operates the servomotor to dwell a position of the elongated label applying arm for a set time, and thereafter operates the servomotor to rotate the elongated label applying arm back to the label load position.

15. The label applying system of claim 14, wherein the elongated label applying arm is configured to have shape memory and therefore is elastically bendable so as to return to a planar configuration when the elongated label applying arm returns to the label load position.

16. The label applying system of claim 15, wherein the elongated label applying arm is of a thin sheet or thin plate configuration, wherein the label carrying free end portion includes a plurality of openings from a label carrying side to an opposite side.

17. The label applying system of claim 16, wherein an air mover is positioned to create a pressure drop across the label carrying free end portion of the elongated label applying arm, via the plurality of openings, for holding a label on the label carrying portion when the elongated label applying arm is in the label load position, wherein, when the elongated label applying arm moves away from the label load position toward the label apply position, the label carrying portion moves away from the air mover such that the pressure drop across the label carrying free end portion caused by the air mover is removed.

18. The label applying apparatus of claim 14, wherein the elongated label applying arm has a thickness of between 1 mm and 2 mm.

19. The label applying system of claim 14, wherein the elongated label applying arm has a length of between eight inches and twenty-four inches.

20. The label applying system of claim 14, wherein the elongated label applying arm comprises a carbon fiber material.

21. The label applying system of claim 14, wherein the elongated label applying arm is configured such that, during label application, some bend occurs along greater than 50% of a length of the elongated label applying arm and bending of the label carrying portion includes bending of a label contacting surface of the label carrying portion.

22. The label applying system of claim 14, wherein the servomotor is mounted at one side of a support and the shaft extends from the servomotor, through an opening in the support, and into engagement with the elongated label applying arm at an opposite side of the support.

23. A label applying system, comprising:

a label print unit with an associated label output;

a motor;

a shaft connected to the motor for being rotated by the motor;

an air mover;

an elongated label applying arm connected to the shaft for pivotable movement between a label load position and a label apply position, wherein the elongated label applying arm includes a label carrying free end portion that is positioned to receive labels from the label output when the elongated label applying arm is in the label load position, wherein the elongated label applying arm is flexible;

wherein the label carrying portion includes a label carrying side and an opposite side, and at least one opening that extends through the label carrying portion from the label carrying side to the opposite side;

wherein, when the elongated label applying arm is in the label load position, operation of the air mover holds a label on the label carrying portion;

wherein, when the elongated label applying arm moves away from the label load position toward the label apply position, the label carrying portion moves away from the air mover.

24. The label applying system of claim 23, wherein, when the elongated label applying arm is in the label load position, operation of the air mover creates a pressure condition at the label carrying portion to hold the label on the label carrying portion, wherein, when the elongated label applying arm moves away from the air mover, the pressure condition at the label carrying portion caused by operation of the air mover is removed.

25. The label applying system of claim 24, wherein, when the pressure condition is removed, a rotational acceleration of the elongated label applying arm toward the label apply position, in combination with a frictional force between the label carrying portion and the label, keep the label on the label carrying portion until the elongated label applying arm pushes the label into contact with the item to apply the label.

26. The label applying system of claim 23, wherein the elongated label applying arm has a defined mass and the label carrying side has a defined surface area, wherein a ratio of the defined mass to the defined surface area is no more than 0.00650 pounds per square inch.

27. The label applying system of claim 23, wherein the motor is configured to pivot the arm from the label load position toward the label apply position at a rotational acceleration of at least 400 degrees per second.

28. The label applying system of claim 23, further comprising:

the motor is a servomotor;

a control system configured to operate the servomotor to rotate the elongated label applying arm in a controlled manner such that, as the elongated label applying arm is rotated toward the label apply position, when the control system detects, based upon servomotor feedback, application of a force to the elongated label applying arm, the control system operates the servomotor to dwell a position of the elongated label applying arm for a set time, and thereafter operates the servomotor to rotate the elongated label applying arm back to the label load position.

* * * * *